US007260524B2

(12) United States Patent
Jabri et al.

(10) Patent No.: US 7,260,524 B2
(45) Date of Patent: Aug. 21, 2007

(54) METHOD FOR ADAPTIVE CODEBOOK PITCH-LAG COMPUTATION IN AUDIO TRANSCODERS

(75) Inventors: Marwan A. Jabri, Sydney (AU); Jian Wei Wang, Glebe (AU); Sameh Georgy, Riverwood (AU); Michael Ibrahim, Ryde (AU)

(73) Assignee: Dilithium Networks Pty Limited (AU)

( * ) Notice: Subject to any disclaimer, the term of this patent is extended or adjusted under 35 U.S.C. 154(b) by 879 days.

(21) Appl. No.: 10/350,349

(22) Filed: Mar. 12, 2003

(65) Prior Publication Data

US 2004/0002855 A1 Jan. 1, 2004

Related U.S. Application Data

(60) Provisional application No. 60/364,403, filed on Mar. 12, 2002.

(51) Int. Cl.
*G10L 19/12* (2006.01)

(52) U.S. Cl. ..... 704/223

(58) Field of Classification Search ..... None
See application file for complete search history.

(56) References Cited

U.S. PATENT DOCUMENTS 5,995,923 A 11/1999 Mermelstein et al.
6,115,687 A 9/2000 Tanaka et al.
6,260,009 B1 * 7/2001 Dejaco ..... 704/221
2004/0158647 A1 8/2004 Omura

FOREIGN PATENT DOCUMENTS

EP 1 363 274 11/2003
JP 08-146997 6/1996

OTHER PUBLICATIONS

Kim et al., "An Efficient Transcoding Algorithm for G.723.1 and EVRC Speech Coders". Vehicular Technology Conference, 2001. VTC 2001 Fall. IEEE, VTS 54th, vol. 3, Oct. 7, 2001, pp. 1561-1564.

* cited by examiner

*Primary Examiner*—Abul K. Azad
(74) *Attorney, Agent, or Firm*—Townsend and Townsend and Crew LLP

(57) ABSTRACT

An apparatus for processing adaptive codebook pitch lag from one CELP based standard to another CELP based standard. The apparatus has various modules that perform at least the functionality described herein. The apparatus includes a time-base subframe checker inspection module, which is adapted to associate one or more incoming subframes with an outgoing subframes of a destination codec. The apparatus also has a decision module coupled to the time-base subframe inspection module. The decision module is adapted to determine a desired pitch lag parameter from a plurality of pitch lag parameters among respective two or more incoming subframes. The apparatus has a pitch lag selection module coupled to the decision module. The pitch lag selection module is adapted to select the desired pitch lag parameter.

52 Claims, 5 Drawing Sheets

METHOD FOR ADAPTIVE CODEBOOK PITCH-LAG COMPUTATION IN AUDIO TRANSCODERS

FIELD OF INVENTION

The present invention relates generally to processing telecommunication signals. More particularly, the invention provides a method and apparatus for translating digital speech packets from one code-excited linear prediction (CELP) format to another CELP format. More specifically, it relates to a method and to an apparatus for interpolating an adaptive codebook pitch lag obtained by a first CELP coder as input into another adaptive codebook pitch lag of a second CELP coder. Merely by way of example, the invention has been applied to voice transcoding, but it would be recognized that the invention may also include other applications.

BACKGROUND OF THE INVENTION

Telecommunication techniques have developed over the years. As merely an example, coding techniques package signals for transmission over telecommunication media. Coding often includes a process of converting a raw signal (voice, image, video, etc) into a format amenable for transmission or storage. The coding usually results in a large amount of compression, but generally involves significant signal processing to achieve. The outcome of the coding is a bitstream (sequence of frames) of encoded parameters according to a given compression format. The compression is achieved by removing statistically and perceptually redundant information using various techniques for modeling the signal. Hence the encoded format is referred to as a "compression format" or "parameter space". The decoder takes the compressed bitstream and regenerates the original signal. In the case of speech coding, compression typically leads to information loss.

Coding can be performed using a codec device. As an example, a CELP-(code excited linear prediction) based codec can be thought of as an algorithm that maps between sampled speech and some parameter space using a model of speech production, i.e. it encodes and decodes the digital speech. Generally all CELP-based algorithms operate on frames of speech which are further divided into several subframes. The frame parameters used in CELP-based models has linear-predictive coefficients (LPC) used for short-term prediction of the speech signal (and physically relating to the vocal tract, mouth and nasal cavity, and lips), as well as an excitation signal composed from adaptive and fixed codebooks. The adaptive codebook is used to model long-term pitch information in the speech. Most of the computational effort in analyzing the speech frame is in determining the LPC coefficients and finding the pitch lag (or equivalently adaptive codeword index).

There exists a large number of diverse networks connected to multiple diverse terminals that each support one (or more) of the many CELP based voice coding standards. A lack of inherent interoperability between voice compression standards often means that there may be a need for translation when an end-to-end call traverses network boundaries. Interconnecting these diverse networks and terminals generally requires voice transcoding from one voice standard into another. A need for such transcoding is typically addressed in mobile switching centers, media gateways, multimedia messaging systems, and on the edge of networks.

As merely an example, voice coding in the context of heterogeneous wireless, mobile and wireline networks illustrate networks that run on different standards. There are a wide variety of voice compression and coding standards used for terminals in different networks—G.729 and G.723.1 for Voice over IP (VoIP), GSM, GSM-AMR, EVRC and a range of other standards used (or emerging) on different wireless networks. FIGS. 1A, 1B and 1C illustrate this diversity of CELP based voice compression standards in a simplified manner. In this case voice transcoding occurs at the edge of every network and between any two networks.

The computation of adaptive codebook pitch-lag plays an important role in searching the adaptive codebook in voice transcoding. As frame size or sub-frame size may be different when transcoding between most popular CELP based standards, re-computing the codebook pitch-lag computation for different subframe size standards becomes challenging. For example, the sub-frame size in G.723.1 is 7.5 ms (FIG. 1B), but it is 5 ms in GSM-AMR (FIG. 1A) and it is either 6.625 ms or 6.75 ms in EVRC (FIG. 1C).

Conventional methods of transcoding including tandem transcoding (a brute-force approach) and some "smart" transcoding methods still reconstruct the speech signal and perform extensive computations to extract the pitch-lag through open-loop or closed-loop searching. That is, these methods still operate in the speech signal space, rather than the parameter space. Accordingly, conventional methods are computationally intensive.

In an attempt to eliminate the pitch-lag interpolation in speech signal space, there is a "smart" transcoding that appears in U.S. Ser. No. 2002/0077812 A1. Although this method performs transcoding between the CELP parameters, it is only available for a special case that generally requires very restricted conditions between source and destination CELP codecs. For example, it generally requires that the Algebraic CELP (ACELP) algorithm be used and that both source and destination codecs have the same subframe size, which has many limitations and cannot be applied broadly.

Thus, there exists a need for an improved voice transcoder to be capable of efficiently computing adaptive codebook pitch-lag.

BRIEF SUMMARY OF THE INVENTION

According to the present invention, techniques for processing telecommunication signals are provided. More particularly, the invention provides a method and apparatus for translating digital speech packets from one code-excited linear prediction (CELP) format to another CELP format. More specifically, it relates to a method and to an apparatus for interpolating an adaptive codebook pitch lag obtained by a first CELP coder as input into another adaptive codebook pitch lag of a second CELP coder. Merely by way of example, the invention has been applied to voice transcoding, but it would be recognized that the invention may also include other applications.

The present invention is a method and apparatus for adaptive codebook pitch-lag computation. The apparatus includes (a) a time-base subframe inspection module that stores the adaptive codebook parameters of each subframe from source codec which waits for interpolation or mapping and computes the proportion of subframe overlapping between source codec and destination codec; (b) a decision module that computes the energy of the adaptive codebook among all source subframes which overlap with the destination subframe and searches the maximum energy value as the criterion for the selection of pitch lag; and (c) a selection module that selects the pitch lag of a subframe as an output from all overlapping source subframes based on an output of the decision module. The time-base subframe inspection module includes a buffer that stores the pitch lag, pitch gain and number of samples of source subframes which wait for mapping into the destination subframe and a discriminator that determines whether destination subframe is covered by multiple source subframes.

The method includes the steps of computing the pitch-lag of the destination subframe from source CELP codec parameter space. The step of computing the pitch-lags includes the steps of storing the adaptive codebook parameters of each source subframe which overlaps with a destination subframe, deciding whether the destination subframe is wholly covered by one source subframe or multiple source subframes, either outputting the pitch lag of the source subframe if the destination subframe is wholly covered by only one source subframe or outputting the pitch lag of the subframe which has the maximum value of the criterion used by a decision module if the destination subframe is covered by multiple source subframes. The step of outputting the pitch lag of a subframe which has the maximum value of the criterion used by a decision module includes steps of searching for the maximum value of the criterion by a decision making module, selecting the pitch lag of a subframe which has the maximum value among all overlapping source subframes, and outputting the pitch lag of that selected subframe. The step of searching the maximum value of the criterion by a decision module includes steps of combining the adaptive codebook parameters of overlapped source subframes, computing the proportion of overlap of each source subframe, computing the energy contribution which is used as the criterion value in each overlapped subframe, and indexing the subframe which has the maximum value of the criterion.

In a specific embodiment, the invention provides an apparatus for processing adaptive codebook pitch lag from one CELP based standard to another CELP based standard. The apparatus has various modules that perform at least functionality described herein. The apparatus includes a time-base subframe inspection module, which is adapted to associate one or more incoming subframes with an outgoing subframes of a destination codec. The apparatus also has a decision module coupled to the time-base subframe inspection module. The decision module is adapted to determine a pitch lag parameter of a desired subframe from a plurality of pitch lag parameters among respective two or more incoming subframes. The apparatus has a pitch lag selection module coupled to the decision module. The pitch lag selection module is adapted to select the desired pitch lag parameter.

In an alternative specific embodiment, the invention provides a method for processing an adaptive codebook parameter pitch-lag from a source CELP based codec to a destination CELP standard codec. The method comprises storing in a memory the more than one adaptive codebook parameters of one or more respective each subframes from a source codec which waits for mapping. The method also decides whether the a destination subframe is wholly covered by one source subframe while the one or more subframes wait for mapping. The method outputs the a pitch lag of the a source subframe if the destination subframe is wholly covered by a single one source subframe; or output the a desired value of a pitch lag of a source subframe which has maximum value of the based upon a criterion by a decision module if the destination subframe is covered by two or more multiple source subframes. Depending upon the embodiment, there can also be other elements.

In a further embodiment, the invention provides a computer based system for processing adaptive codebook pitch lag from one CELP based standard to another CELP based standard. The system includes computer memory, which may be one or more memories. Various codes are provided on the one or more memories. The system includes one or more codes directed to a time-base subframe inspection module, which is adapted to associate one or more incoming subframes with an outgoing subframes of a destination codec. The system also includes one or more codes directed to a decision module coupled to the time-base inspection module, which is adapted to determine a desired pitch lag parameter from a plurality of pitch lag parameters among respective the two or more incoming subframes. One or more codes are directed to a pitch lag selection module coupled to the decision module. The decision module is adapted to select the desired pitch lag parameter. Depending upon the embodiment, computer code or codes can be used in the form of software or firm ware to carryout the functionality described herein.

According to a specific embodiment, there can be many benefits and/or advantages. An advantage of the present invention is that it provides a fast pitch-lag parameter computation from one codec into another in transcoding without compromising audio quality according to a specific embodiment. A fast and correct computation algorithm can improve the audio transcoding, not only in terms of computational performance, but more importantly in terms of maintaining audio quality. Depending upon the embodiment, one or more of these advantages may be achieved.

The objects, features, and advantages of the present invention, which to the best of our knowledge are novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE INVENTION

According to the present invention, techniques for processing telecommunication signals are provided. More particularly, the invention provides a method and apparatus for translating digital speech packets from one code-excited linear prediction (CELP) format to another CELP format.

More specifically, it relates to a method and to an apparatus for interpolating an adaptive codebook pitch lag obtained by a first CELP coder as input into another adaptive codebook pitch lag of a second CELP coder. Merely by way of example, the invention has been applied to voice transcoding, but it would be recognized that the invention may also include other applications.

By careful investigation of adaptive codebooks in existing audio codec standards, we find that it is possible to interpolate the codebook pitch-lag parameter from one codec into another in transcoding without compromising audio quality. A fast and correct computation algorithm can improve the audio transcoding, not only in terms of computational performance, but more importantly in terms of maintaining audio quality.

In a specific embodiment, speech signals can be categorized as either voiced or unvoiced signals. The adaptive codebook pitch-lag parameter is quite stable during voiced excitation sequences, but it is not stable during unvoiced sounds or at the onset of voiced sounds. Unvoiced sounds are generally weak, random signals, and in such cases the adaptive codebook gain is very small and the selection of adaptive codebook pitch-lag is not as important as for voiced signals. Voiced signals, on the other hand are generally strong and stable, and the selection of adaptive codebook pitch-lag directly determines the quality of the speech compression.

Figure 3:
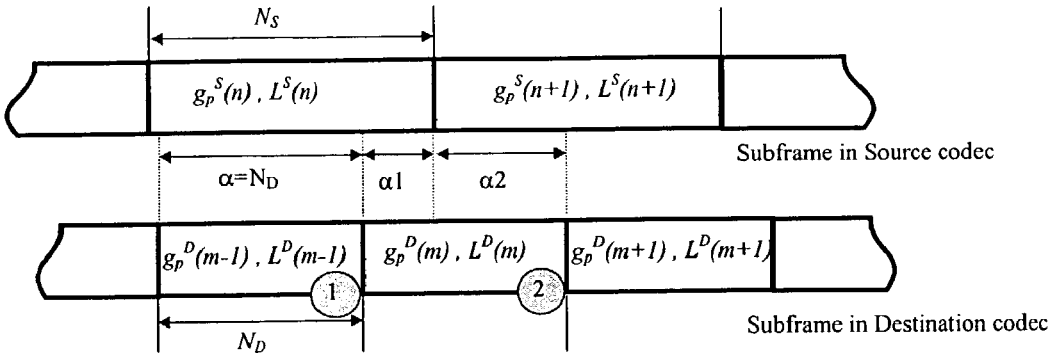
FIG. 3 is a simplified diagram showing a comparison of different subframe size between source and destination codecs and overlapping according to an embodiment of the present invention.

Although the optimized adaptive codebook pitch-lags in different audio codecs are very close, a smart adaptive codebook pitch-lag computation is necessary in audio transcoding. This is because the subframe size between source and destination codecs can be different (FIG. 3). As shown, the subframe in the source codec includes a size of $N_S$ for the first subframe. The destination codec (see reference numeral 1) has a first subframe of $N_D$, which is smaller in size than the first codec subframe. As further shown, an edge of the first source codec and first destination codec align. Since the first source subframe is large in size and also has a spatial alignment that extends beyond the first destination subframe, the first destination subframe is covered (i.e., wholly covered) by the first source subframe. As also shown is a second destination subframe (see reference numeral 2), which has a portion $\alpha 1$ and a portion $\alpha 2$, which overlaps the first subframe of the source codec and the second subframe of the source codec. The second destination subframe is not covered by a single source subframe. Further details of the invention as applied to processing different sized subframes are provided throughout the present specification and more particularly below.

According to a specific embodiment, we provided at least a method to interpolate adaptive codebook pitch-lag in audio transcoding for different sized subframes as well as other variations, modifications, and alternatives.

Figure 1A:
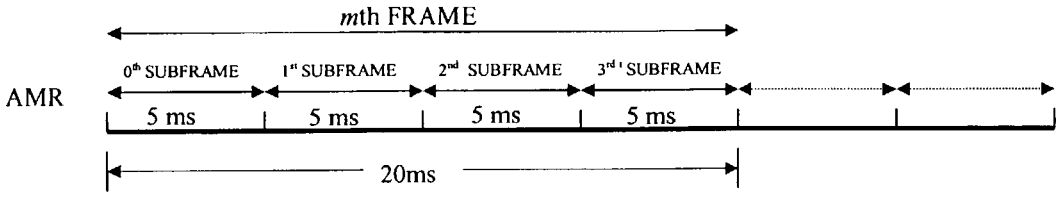
Figure 1A PRIOR ART
FIGS. 1A, 1B and 1C are diagrams useful in illustrating the different subframe sizes used in different CELP codecs.
Figure 1B:
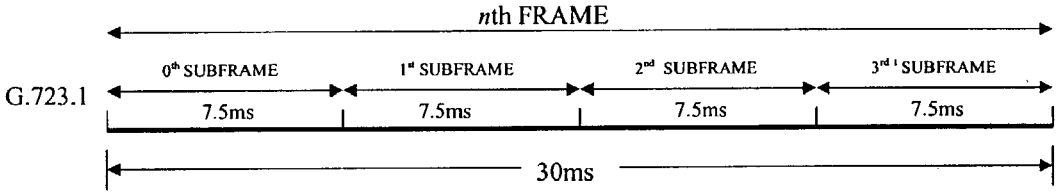
Figure 1B PRIOR ART
Figure 1C:
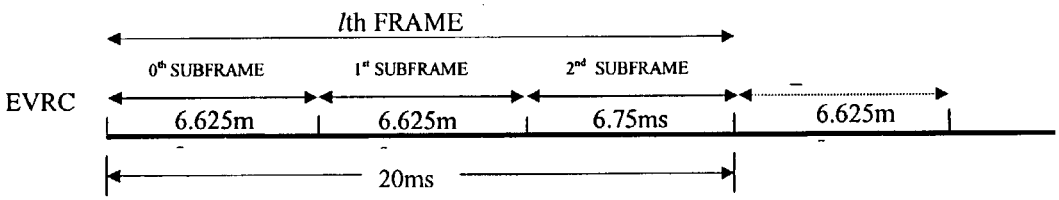
Figure 1C PRIOR ART
Figure 2:
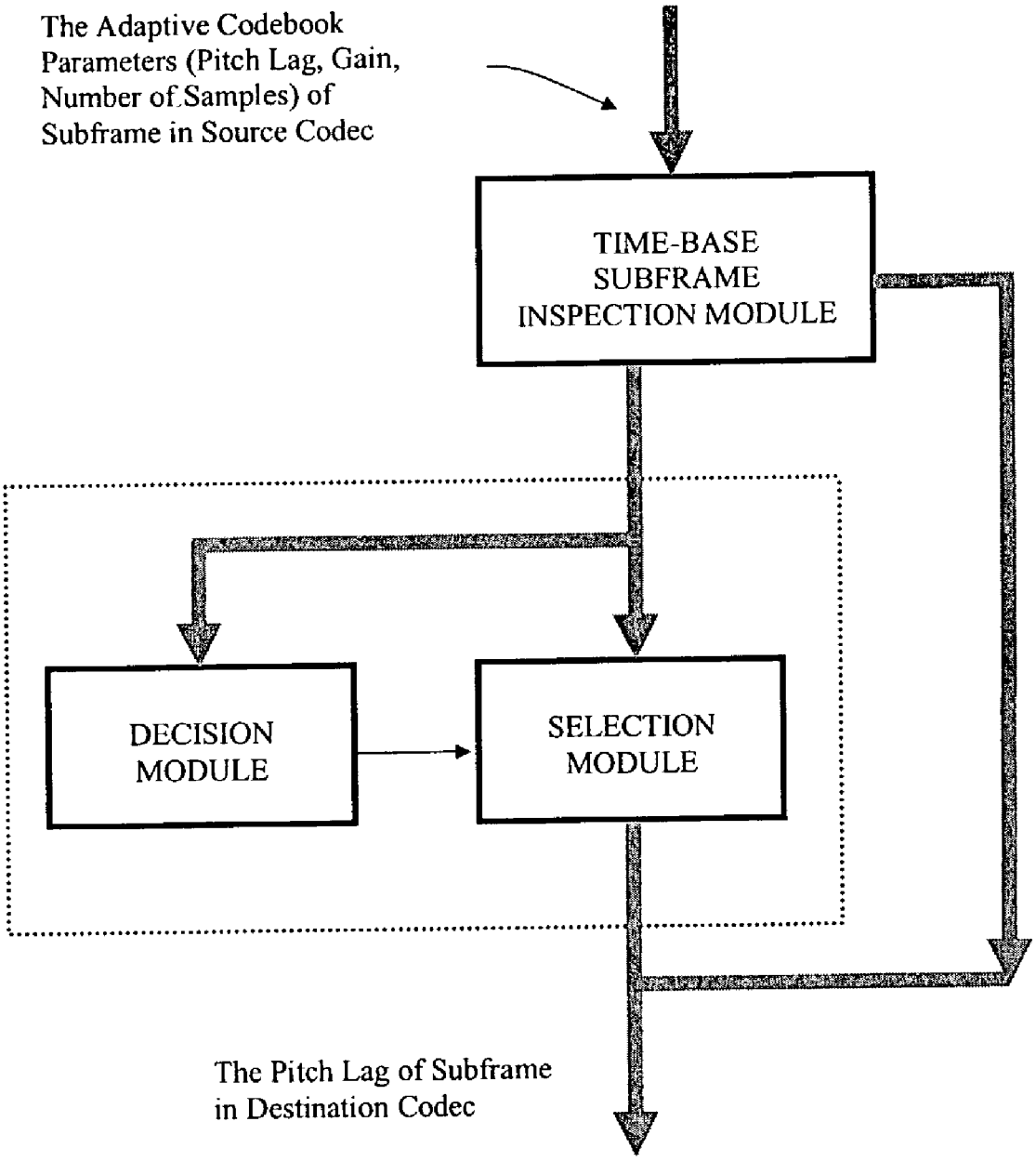
FIG. 2 is a simplified function block diagram for performing adaptive codebook pitch lag interpolation according to an embodiment of the present invention.

FIG. 2 illustrates a hierarchy of the building blocks used in the pitch lag interpolation according to the present invention. This diagram is merely an example, which should not unduly limit the scope of the claims herein. One of ordinary skill in the art would recognize many variations, modifications, and alternatives. According to a specific embodiment, a Time-Base Subframe Inspection Module handles the subframe interpolation between the source codec and the destination codec due to the dissimilar subframe sizes of the source and destination codecs; the module handles all cases of source and destination subframe length (i.e. the source subframe length is shorter than the destination subframe, the source subframe length is longer than the destination subframe length and the source subframe length is equal to the destination subframe length). The Quick Decision Module computes the criteria of selection function of desired pitch lag for the destination codec. The Selection Module handles the computation of the final pitch lag based on the criteria output computed by the Quick Decision Module. Note that the Time-Base Subframe Inspection Module can directly connect to the output (i.e. can bypass the Quick Decision Module and the Selection Module). This is so because the Time-Base Subframe Inspection Module has the ability to map it directly to the output. This is determined by the Time-base Inspection Module based on the position of the destination subframe with relation to the source subframe in time.

Referring to FIG. 3 again, suppose that the adaptive codebook gain, adaptive codebook pitch-lag and the subframe size in the source codec are $g_p^S$, $L^S$, $N_S$, respectively, and the subframe size in the destination codec is $N_D$. The subframe size of the source codec can be different to that of the destination. Furthermore, the source and destination frames may not be aligned and they can be overlapped. Depending upon the particular embodiment, we have described various embodiments list under different case headings, which are merely provided to be illustrating. These embodiments are not intended to be limiting the scope of the claims herein. One of ordinary skill in the art would recognize many variations, alternatives, and modifications.

Case 1: If the destination subframe is fully covered by one subframe from the source codec, the adaptive codebook pitch-lag for the destination is:

$$L_D = L_S \quad \text{(Eq. 1)}$$

Case 2: If the destination subframe is covered by multiple subframes from the source, the adaptive codebook pitch-lag is the pitch-lag of the source subframe for which a function of adaptive codebook gain and overlapping size is the maximum. It can be expressed as:

$$L_D = L_{s_n}|_{E_n = E_{max}},$$

where $E_n$ is a function of adaptive gain $g_p^S$ and the portion of overlapping $\alpha$ in source sub-frame:

$$E_n = \alpha_n \cdot g_p^2,$$

and $E_{max}$ is the maximum E amongst all subframes which are overlapped with the destination subframe m $$E_{max} = \max(E_1, E_2, \ldots, E_n).$$

Thus, the selected adaptive codebook pitch-lag can be used as adaptive codebook pitch-lag for the destination subframe, or as open-loop adaptive codebook pitch-lag if further tuning is required.

Figure 4:
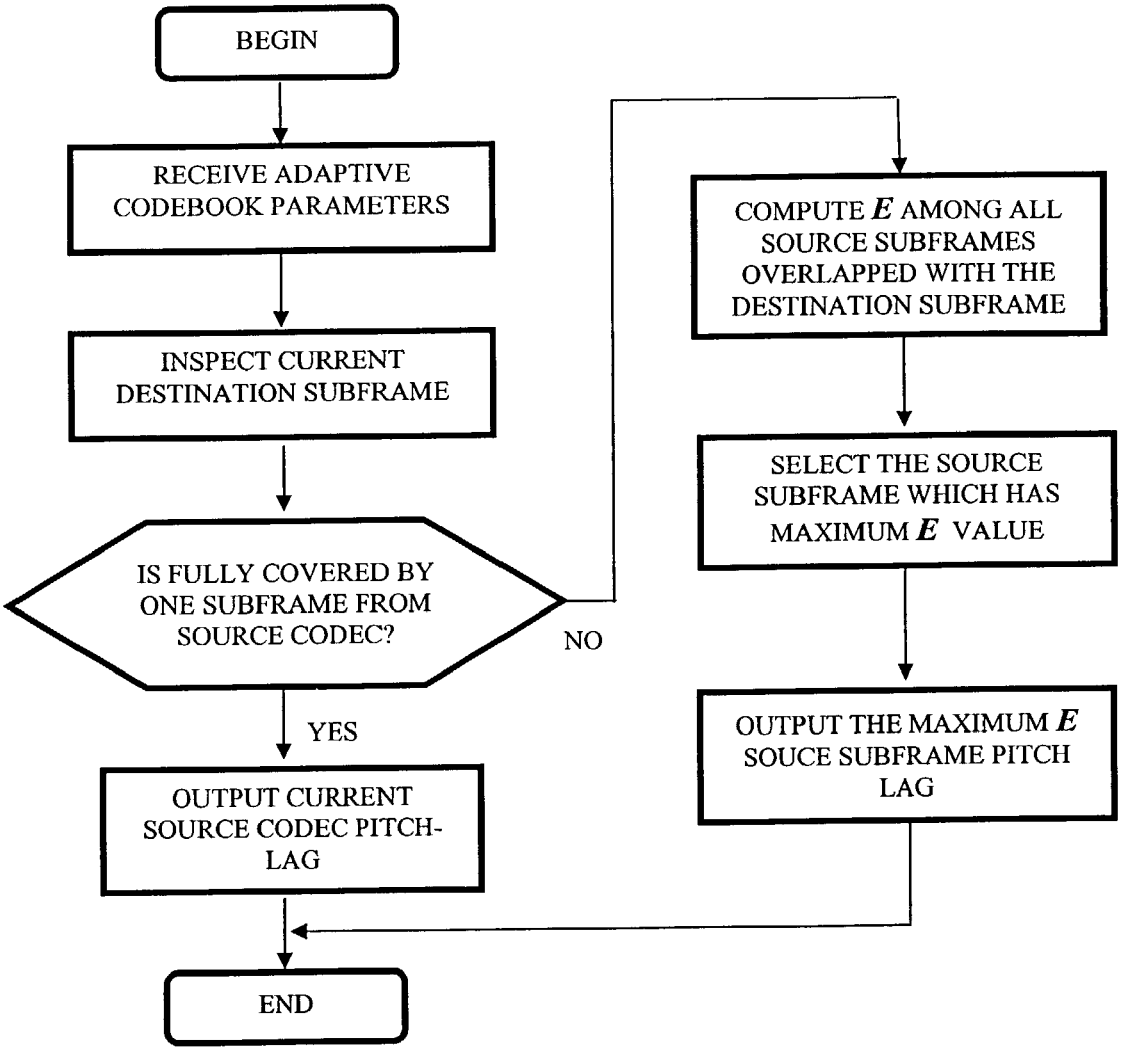
FIG. 4 is a simplified flow diagram illustrating a routine for interpolating pitch lag for different subframe sizes according to an embodiment of the present invention.

In FIG. 4, a flowchart describing the operation flow of the present invention is illustrated. This diagram is merely an example, which should not unduly limit the scope of the claims herein. One of ordinary skill in the art would recognize many variations, modifications, and alternatives. The adaptive codebook parameters reach the input of the interpolator module of the audio transcoder. A check for the current destination subframe alignment in relation to the source subframe is made. If the destination subframe is completely covered by one subframe of the source codec, the pitch lag at the destination subframe is equal to the corresponding pitch lag of the source subframe as specified in Eq. 1.

If the destination subframe is covered by two or more subframes from the source codec, the selection module within the audio transcoder searches through the overlapping source subframes for the maximum criteria as specified in equations 2 and 3.

The basis for the criteria in equations 2 and 3 is the strength of the pitch gain in the source codec subframes. During the silence periods in a normal conversation, the adaptive codebook gain is very small and that contrasts with voiced periods, where the pitch gain is strong. Therefore, depending on the portion of overlapping source subframe, as specified by the factor $\alpha$ from equation 3 and the magnitude of the pitch gain, the decision criteria as specified in equation 3 ($E_n$) are calculated.

The pitch lag is then outputted at the destination codec. Note the computed pitch lag should fit within the allowed index range of the pitch lag for the destination codec. In the case of the computed pitch lag not fitting in the allowed index range of the destination code, the pitch lag may be either doubled or halved depending on where it falls, whether at the minimum allowed pitch or at the maximum allowed pitch, respectively. Depending upon the embodiment, we have also provided specific examples for illustrative purposes only. These examples can be found throughout the present specification and more particularly below.

G.723.1 ⇔GSM-AMR TRANSCODING EXAMPLE

Figure 5:
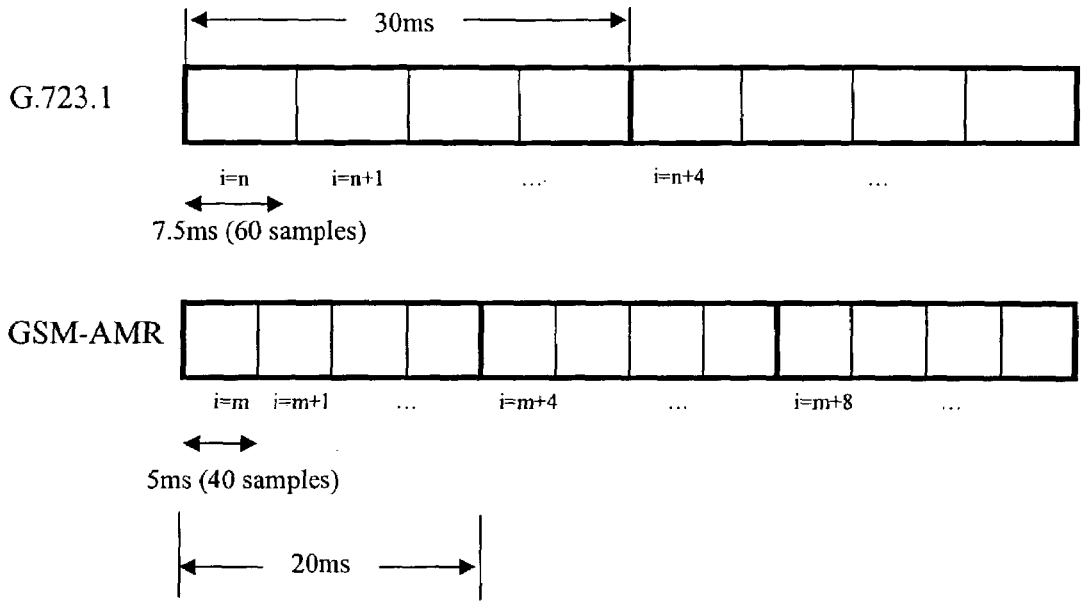
FIG. 5 is a simplified block diagram showing the subframe computation in the particular example of transcoding from G.723.1 to GSM-AMR according to an embodiment of the present invention.

As an illustrative example, we show how the adaptive codebook pitch-lag is interpolated in a G.723.1 to GSM-AMR transcoder (FIG. 5). Again, this diagram is merely an example, which should not unduly limit the scope of the claims herein. One of ordinary skill in the art would recognize many variations, modifications, and alternatives.

It can be seen from FIG. 5 that three GSM-AMR subframes are needed to describe the same duration of speech signal as two G.7231 sub-frames. Likewise three GSM-AMR sub-frames are needed for every two G.723.1 subframes. If the source codec is G.723.1 and the destination codec is GSM-AMR, the GSM-AMR adaptive codebook pitch-lag after computation is as follows:

(1) The $m^{th}$ subframe: GSM-AMR subframe is 5 ms and G.723.1 subframe is 7.5 ms. The GSM-AMR subframe {m} is fully covered by the G723.1 subframe {n}. According to the equation (1), its adaptive codebook pitch-lag is $$L_m^{GSM-AMR} = L_n^{G723.1}$$

(2) The $(m+1)^{th}$ subframe: The $\{m+1\}^{th}$ subframe is covered by two source subframes {n} and {n+1}, The overlapping of GSM-AMR subframe {m} to G.723.1 subframe {n} is the same as that of {m} to {n+1}. Thus the computation is determined by the source adaptive codebook gain. According to the equation (2) and (3), the $\{m+1\}^{th}$ subframe adaptive codebook pitch-lag can be obtained as:

$$L_{m+1}^{GSM-AMR} = \begin{cases} L_n^{G723.1} & \text{if } G_{P_n} > G_{P_{n+1}} \\ L_{n+1}^{G723.1} & \text{otherwise} \end{cases}$$

where $G_P$ is the pitch gain.

(3) The $(m+2)^{th}$ subframe: The (m+2)th subframe is covered by the G723.1 subframe (n+1) only. It is therefore that the adaptive codebook pitch-lag is the same as G723.1.

$$L_{m+2}^{GSM-AMR} = L_{n+1}^{G723.1}$$

(4) The adaptive codebook pitch-lag of subsequent subframes can be obtained as above.

Other Celp Transcoders

According to other specific embodiments, the invention of adaptive codebook computation described in this document is generic to all CELP based voice codecs, and applies to any voice transcoders between the existing codecs G.723. 1, GSM-AMR, EVRC, G.728, G.729, G.729A, QCELP, MPEG-4 CELP, SMV and all other future CELP based voice codecs that make use of pitch lag information.

The previous description of the preferred embodiment is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

What is claimed is:

1. An apparatus for processing an adaptive codebook pitch lag from a source CELP based codec to a destination CELP based codec, the apparatus comprising:

a time-base subframe inspection module adapted to associate one or more incoming subframes of the source CELP based codec with an outgoing subframe of destination CELP based codec;

a decision module coupled to the time-base subframe inspection module, the decision module being adapted to output an incoming subframe among respective one or more incoming subframes; and a pitch lag selection module coupled to the decision module, the pitch lag selection module being adapted to retrieve a pitch lag associated with the incoming subframe and use the retrieved pitch lag to determine a pitch lag associated with the outgoing subframe.

2. The apparatus of claim 1 wherein the time-base subframe inspection module is a single module or multiple modules.

3. The apparatus of claim 1 wherein the decision module is adapted to determine that the incoming subframe has a maximum value of a function of an adaptive codebook pitch gain and a proportion of an overlapping factor associated with the one or more incoming subframes.

4. The apparatus of claim 1 wherein the pitch lag parameter is a pitch lag of the incoming subframe that has a portion of duration covered by the outgoing subframe.

5. The apparatus of claim 1 wherein the decision module is a single module or multiple modules.

6. The apparatus of claim 1 wherein the pitch lag selection module is a single module or multiple modules.

7. The apparatus of claim 1 wherein the source CELP based codec is selected from the group consisting of G.723.1, GSM, GSM-AMR, EVRC, G.728, G.729, G.729A, QCELP, MPEG-4 CELP, and SMV.

8. The apparatus of claim 1 wherein the incoming subframe or the outgoing subframe has a subframe size of 5 ms, 6.625 ms, 6.75 ms, or 7.5 ms.

9. The apparatus of claim 1 wherein the source CELP based codec has a same subframe size as the destination CELP based codec.

10. The apparatus of claim 1 wherein the source CELP based codec is G.723.1.

11. The apparatus of claim 10 wherein the destination CELP based codec is GSM-AMR.

12. The apparatus of claim 1 wherein the source CELP based codec is GSM-AMR.

13. The apparatus of claim 12 wherein the destination CELP based codec is G.723.1.

14. The apparatus of claim 12 wherein the destination CELP based codec is EVRC.

15. The apparatus of claim 1 wherein the source CELP based codec is EVRC and the destination CELP based codec is GSM-AMR.

16. The apparatus of claim 1 wherein the source CELP based codec has a same sampling rate as the destination CELP based codec.

17. The apparatus of claim 1 wherein the source CELP based codec has a different sampling rate as the destination CELP based codec.

18. The apparatus of claim 1 wherein the source CELP based codec has a different subframe size than the destination CELP based codec.

19. The apparatus of claim 18 wherein the source CELP based codec has a subframe size of 7.5 ms and the destination CELP based codec has a subframe size of 5 ms.

20. The apparatus of claim 18 wherein the source CELP based codec has a subframe size of 5 ms and the destination CELP based codec has a subframe size of 7.5 ms.

21. The apparatus of claim 1, wherein said time-base subframe inspection module comprises:

an adaptive codebook buffer adapted to store a pitch lag, a pitch gain, and one or more samples of the one or more incoming subframes for mapping into the outgoing subframe, and a discriminator coupled to the adaptive codebook buffer, the discriminator being adapted to determine whether the outgoing subframe is covered by two or more incoming subframes.

22. The apparatus of claim 21 wherein the discriminator is adapted to:

determine if the outgoing subframe is covered by a single incoming subframe;

bypass the decision module and the selection module;

retrieve the pitch lag associated with the single incoming subframe; and use the retrieved pitch lag in the outgoing subframe of the destination codec.

23. The apparatus according to claim 1 wherein the decision module calculates an energy associated with an adaptive codebook in each of the one or more incoming subframes using the following equation:

$$E_n = \alpha_n \cdot g_p^2$$

wherein $E_n$ is a function of an adaptive codebook gain $g_p^s$ and $\alpha$ is a portion of overlap between the incoming subframe and the outgoing subframe.

24. The apparatus according to claim 1 wherein the decision module searches for a maximum value of a criterion associated with the incoming subframe using the following equation:

$$E_{max}=\max(E_1,E_2 \ldots E_n),$$

wherein $E_{max}$ is the maximum E among the one or more incoming subframes which are overlapped with the outgoing subframe.

25. A method for processing an adaptive codebook pitch lag from a source CELP based codec to a destination CELP based codec, the method being performed without reconstructing a speech signal, the method comprising:

receiving a source frame comprising a first source subframe having a first pitch lag and a second source subframe having a second pitch lag;

deciding whether a destination subframe is wholly covered by the first source subframe;

outputting a pitch lag of the first source subframe if the destination subframe is wholly covered by the first source subframe, or outputting a pitch lag generated from a function if the destination subframe is covered by the first source subframe and the second source subframe, wherein the function utilizes the first pitch lag and the second pitch lag as inputs.

26. The method of claim 25 wherein the function outputs a pitch lag determined by:

searching for a maximum value of a criterion associated with each of the two or more source subframes;

retrieving a pitch lag associated with a source subframe of the two or more source subframes which has the maximum value of the criterion; and outputting the retrieved pitch lag as a pitch lag in the destination subframe.

27. The method of claim 25 wherein the method is performed without reconstructing a speech signal.

28. The method of claim 25 wherein the output pitch lag value is a pitch lag of a source subframe for which a portion of the source subframe overlaps with a portion of the destination subframe.

29. The method of claim 25 wherein a first source subframe of the two or more source subframes comprises an incoming initial sample and the destination subframe comprises an outgoing initial sample, wherein the outgoing initial sample corresponds to the incoming initial sample.

30. The method of claim 26 wherein searching for a maximum value comprises:

computing a proportion of each of the two or more source subframes that overlaps with the destination subframe;

computing an energy of each of the two or more source subframes, the energy being a function of an adaptive codebook pitch gain of each of the two or more source subframes and the proportion of each of the two or more source subframes; and determining a source subframe which has a maximum value of the energy of each of the two or more source subframes.

31. The method of claim 25 wherein the source CELP based codec is selected from the group consisting G.723.1, GSM, GSM-AMR, EVRC, G.728, G.729, G.729A, QCELP, MPEG-4 CELP, and SMV.

32. The method of claim 25 wherein the source subframe or the destination subframe has subframe size of 5 ms, 6.625 ms, 6.75 ms, or 7.5 ms.

33. The method of claim 25 wherein the function generates an output equal to one of the pitch lags associated with one of the two or more source subframes.

34. The method of claim 25 wherein:

a first source subframe of the two or more source subframes comprises an incoming sample, wherein the incoming sample is not an initial sample of the first source subframe; and the destination subframe comprises an outgoing initial sample, wherein the outgoing initial sample corresponds to the incoming sample.

35. The method of claim 25 wherein:

a first source subframe of the two or more source subframes comprises an incoming initial sample; and the destination subframe comprises an outgoing sample, wherein the outgoing sample is not an initial sample of the destination subframe and the outgoing sample corresponds to the incoming initial sample.

36. The method of claim 25 wherein the output pitch lag value is a pitch lag of an incoming source subframe, a portion of the incoming source subframe overlapping with a portion of the destination subframe.

37. The method of claim 25 wherein the method is performed free from an open-book search and a closed-book search.

38. A computer based system for processing an adaptive codebook pitch lag from a source CELP based codec to a destination CELP based codec, the computer based system comprising:

a. one or more codes directed to a time-base subframe inspection module adapted to associate one or more incoming subframes of the source CELP based codec with an outgoing subframe of the destination CELP based codec;

b. one or more codes directed to a decision module coupled to the time-base subframe inspection module, the decision module being adapted to output an incoming subframe among respective one or more incoming subframes; and c. one or more codes directed to a pitch lag selection module coupled to the decision module, the pitch lag selection module being adapted to retrieve a pitch lag associated with the incoming subframe and use the retrieved pitch lag to determine a pitch lag associated with the outgoing subframe.

39. The system of claim 38 wherein the time-base subframe inspection module is a single module or multiple modules.

40. The system of claim 38 wherein the decision module is adapted to determine that the incoming subframe has a maximum value of a function of an adaptive codebook pitch gain and a proportion of an overlapping factor associated with the one or more incoming subframes.

41. The system of claim 38 wherein the pitch lag is a pitch lag of the incoming subframe that has a portion of duration covered by the outgoing subframe.

42. The system of claim 38 wherein the decision module is a single module or multiple modules.

43. The system of claim 38 wherein the pitch lag selection module is a single module or multiple modules.

44. The system of claim 38 wherein the source CELP based codec has a different subframe size than the destination CELP based codec.

45. The system of claim 38 wherein said time-base subframe inspection module comprises:

a. one or more codes directed to an adaptive codebook buffer adapted to store a pitch lag, a pitch gain, and one or more number of samples of the one or more incoming subframes for mapping into the outgoing subframe, and b. one or more codes directed to a discriminator coupled to the adaptive codebook buffer, the discriminator being adapted to determine whether the outgoing subframe is covered by two or more incoming subframes.

46. A method for processing an adaptive codebook pitch lag from a source CELP based codec to a destination CELP based codec, the method comprising:

receiving one or more source frames coded in the source CELP based codec, the one or more source frames comprising a plurality of source subframes, each of the plurality of source subframes having a pitch lag associated with each source subframe; and outputting a destination frame coded in the destination CELP based codec, the destination frame comprising a destination subframe having a pitch lag assigned without reconstructing a speech signal, wherein outputting the destination frame comprises:

determining whether the destination subframe is wholly covered by a single source subframe of the plurality of source subframes;

if the destination subframe is wholly covered by the single source subframe, assigning a pitch lag for the destination subframe equal to a pitch lag of the single source subframe; and if the destination subframe is covered by two source subframes of the plurality of source subframes:

computing a first proportion based on an overlap between the destination subframe and a first source subframe of the two source subframes;

computing a second proportion based on an overlap between the destination subframe and a second source subframe of the two source subframes;

computing a first energy as a function of the first proportion and an adaptive codebook pitch gain of the first source subframe;

computing a second energy as a function of the second proportion and an adaptive codebook pitch gain of the second source subframe; and assigning a pitch lag for the destination subframe equal to the pitch lag of the first source subframe if the first energy is greater than the second energy or equal to the pitch lag of the second source subframe if the second energy is greater than the first energy.

47. The method of 46 wherein:

the source CELP based codec is G.723.1 and the destination CELP based codec is GSM-AMR;

the destination subframe is wholly covered by a single source subframe;

the single source subframe comprises an incoming initial sample; and the destination subframe comprises an outgoing initial sample, wherein the outgoing initial sample corresponds to the incoming initial sample.

48. The method of 46 wherein:

the source CELP based codec is G.723.1 and the destination CELP based codec is GSM-AMR;

the destination subframe is covered by two source subframes; and the pitch lag of the destination subframe is equal to the pitch lag of the second source subframe.

49. The method of 46 wherein:

the source CELP based codec is GSM-AMR and the destination CELP based codec is G.723.1;

the destination subframe is covered by two source subframes; and the pitch lag of the destination subframe is equal to the pitch lag of the first source subframe, wherein the first energy is greater than the second energy.

50. The method of 46 wherein:

the source CELP based codec is GSM-AMR and the destination CELP based codec is EVRC;

the destination subframe is covered by two source subframes;

the first source subframe comprises an incoming initial sample; and the destination subframe comprises an outgoing sample, wherein the outgoing sample is not an initial sample of the destination subframe and the outgoing sample corresponds to the incoming initial sample.

51. The method of 46 wherein:

the source CELP based codec is EVRC and the destination CELP based codec is GSM-AMR; and the destination subframe is wholly covered by a single source subframe, wherein the single source subframe is 6.75 ms in duration and the destination subframe is a final subframe of the destination frame.

52. The method of 46 wherein:

the source CELP based codec is EVRC and the destination CELP based codec is G.723.1;

the destination subframe is covered by two source subframes;

the pitch lag of the destination subframe is equal to the pitch lag of the first source subframe; and the first source subframe overlaps with a greater portion of the destination subframe than the second source subframe.

* * * * *